US010533143B2

(12) United States Patent
Lee et al.

(10) Patent No.: US 10,533,143 B2
(45) Date of Patent: Jan. 14, 2020

(54) COMBUSTOR-INDEPENDENT FLUIDIZED BED INDIRECT GASIFICATION SYSTEM

(71) Applicant: KOREA INSTITUTE OF INDUSTRIAL TECHNOLOGY, Chungcheongnam-do (KR)

(72) Inventors: Uen Do Lee, Daejeon (KR); Byung Ryeul Bang, Seoul (KR); Chang Won Yang, Incheon (KR); Jong Su Kim, Gyeonggi-do (KR); Tae U Yu, Seoul (KR)

(73) Assignee: KOREA INSTITUTE OF INDUSTRIAL TECHNOLOGY, Chungcheongnam-Do (KR)

( * ) Notice: Subject to any disclaimer, the term of this patent is extended or adjusted under 35 U.S.C. 154(b) by 3 days.

(21) Appl. No.: 15/324,371

(22) PCT Filed: Feb. 10, 2015

(86) PCT No.: PCT/KR2015/001337
§ 371 (c)(1),
(2) Date: Jan. 6, 2017

(87) PCT Pub. No.: WO2016/006785
PCT Pub. Date: Jan. 14, 2016

(65) Prior Publication Data

US 2017/0175016 A1 Jun. 22, 2017

(30) Foreign Application Priority Data

Jul. 10, 2014 (KR) ..... 10-2014-0086917

(51) Int. Cl.
*C10J 3/56* (2006.01)

(52) U.S. Cl.
CPC ..... *C10J 3/56* (2013.01); *C10J 2200/158* (2013.01); *C10J 2300/093* (2013.01);
(Continued)

(58) Field of Classification Search
CPC ..... C10J 2300/1637; C10J 2300/15; C10J 2300/158
See application file for complete search history.

(56) References Cited

U.S. PATENT DOCUMENTS 8,349,504 B1 * 1/2013 Radovich ..... C01B 3/32 429/416
2010/0024297 A1 * 2/2010 Suda ..... C10J 3/482 48/61

(Continued)

FOREIGN PATENT DOCUMENTS

JP 09109149 A 4/1997
KR 10-0150624 B1 12/1998

(Continued)

*Primary Examiner* — Matthew J Merkling
(74) *Attorney, Agent, or Firm* — McNees Wallace & Nurick LLC

(57) ABSTRACT

The present invention relates to a combustor-independent fluidized bed indirect gasification system for technology for obtaining high quality synthetic gas through effective indirect gasification of low quality fuels, such as biomass/waste/coal, having various properties, and provides a combustor-independent fluidized bed indirect gasification system comprising: a pre-processor having a sorter 500; a gasifier 300 to which a first fuel sorted in the pre-processor is supplied; a combustor 100 to which a second fuel sorted in the pre-processor is supplied; and a riser 200 connecting the gasifier 300 and the combustor 100 and having functions of increasing the temperature of a bed material and transferring the bed material therein.

6 Claims, 5 Drawing Sheets

(52) U.S. Cl.
CPC ..... *C10J 2300/0906* (2013.01); *C10J 2300/0916* (2013.01); *C10J 2300/1637* (2013.01)

(56) References Cited

U.S. PATENT DOCUMENTS

| | | | | |
|---|---|---|---|---|
| 2010/0181539 | A1* | 7/2010 | Apanel | B01J 8/0055 252/373 |
| 2011/0073021 | A1* | 3/2011 | Takafuji | F23C 10/04 110/218 |
| 2011/0083367 | A1* | 4/2011 | Tetzlaff | C10B 49/10 48/111 |
| 2011/0308230 | A1* | 12/2011 | Takase | F01K 23/068 60/39.182 |
| 2012/0167462 | A1* | 7/2012 | Katagiri | F23C 10/28 48/78 |
| 2013/0161563 | A1* | 6/2013 | Jiang | C01B 3/50 252/373 |
| 2014/0017140 | A1* | 1/2014 | Suda | C10K 1/26 422/187 |
| 2015/0361362 | A1* | 12/2015 | Daggupati | B01J 29/40 252/373 |

FOREIGN PATENT DOCUMENTS

| | | | |
|---|---|---|---|
| KR | 10-2012-0124403 | A | 11/2012 |
| KR | 10-2013-0069586 | A | 6/2013 |
| KR | 10-1271793 | B1 | 6/2013 |
| KR | 10-2014-0058979 | A | 5/2014 |

* cited by examiner

[FIG. 1]
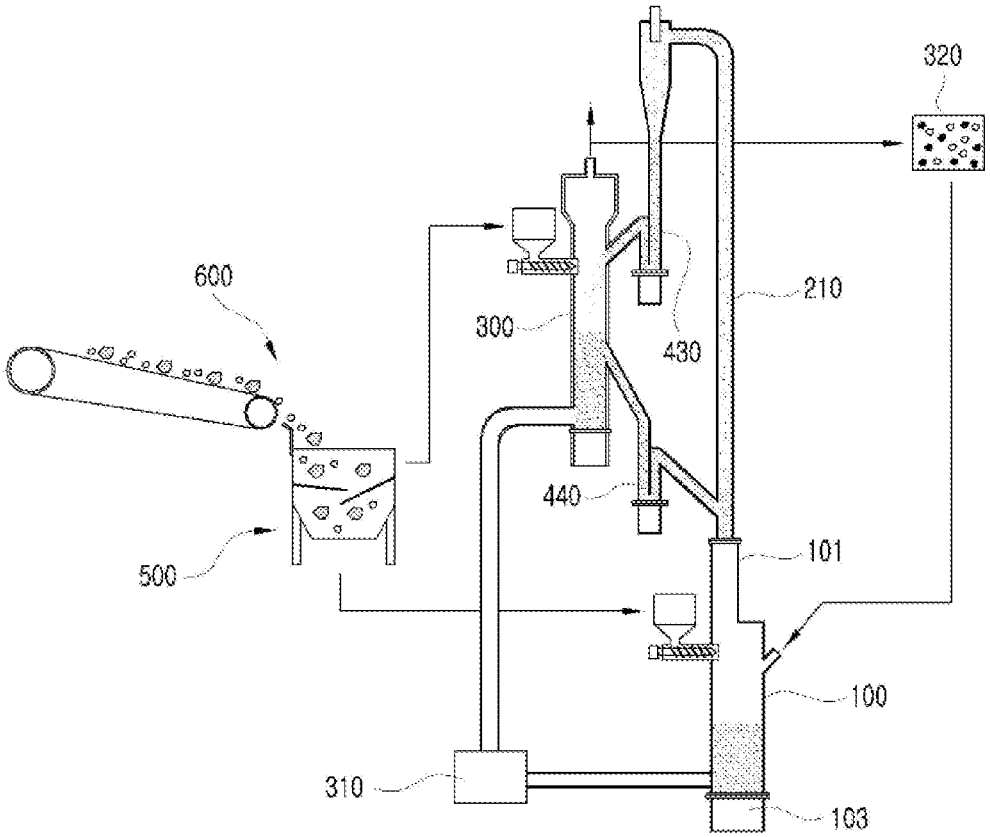

[FIG. 2]
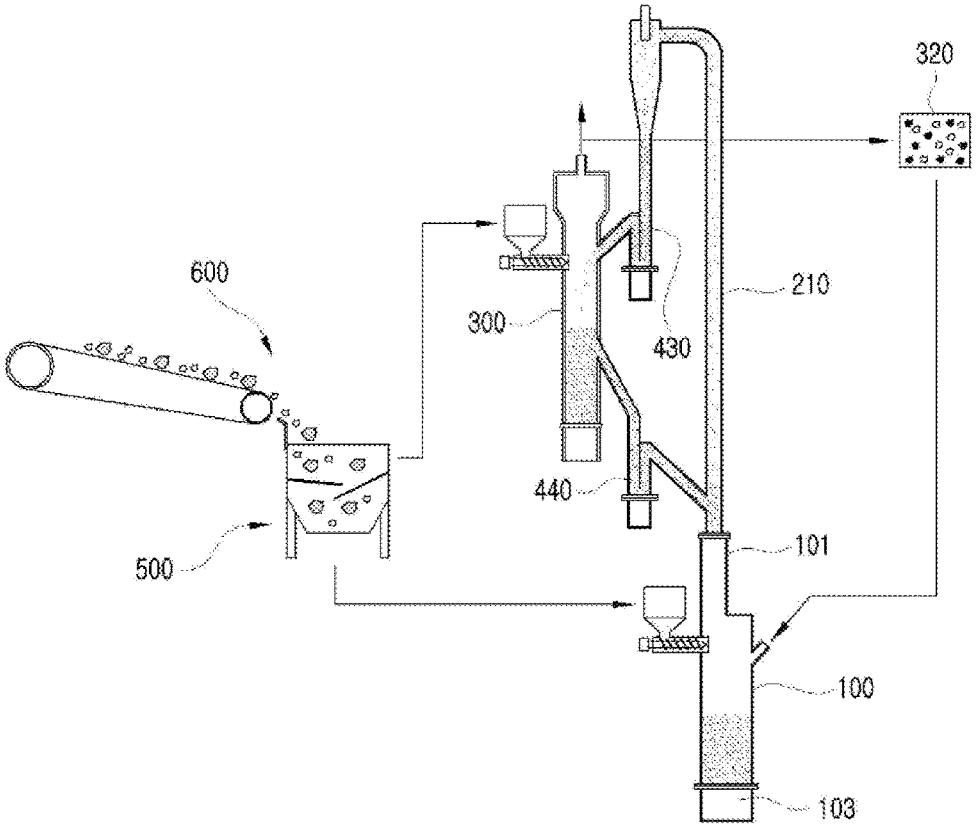

[FIG. 3]
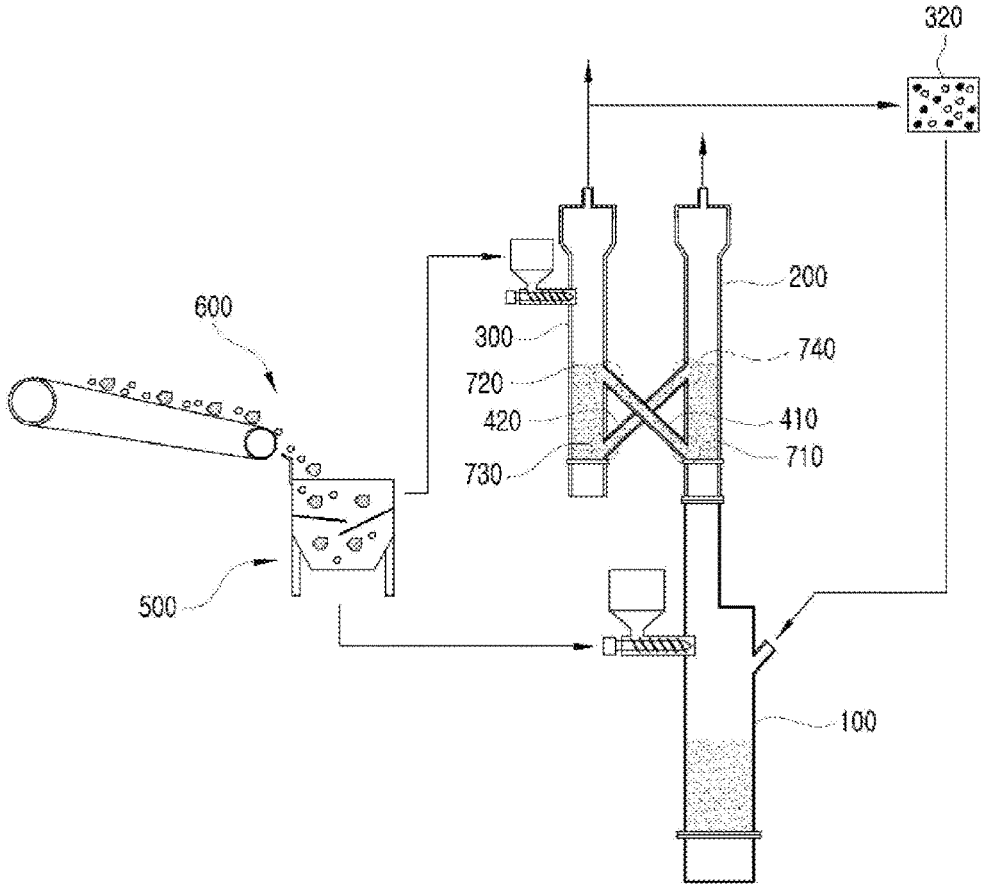

[FIG. 4]
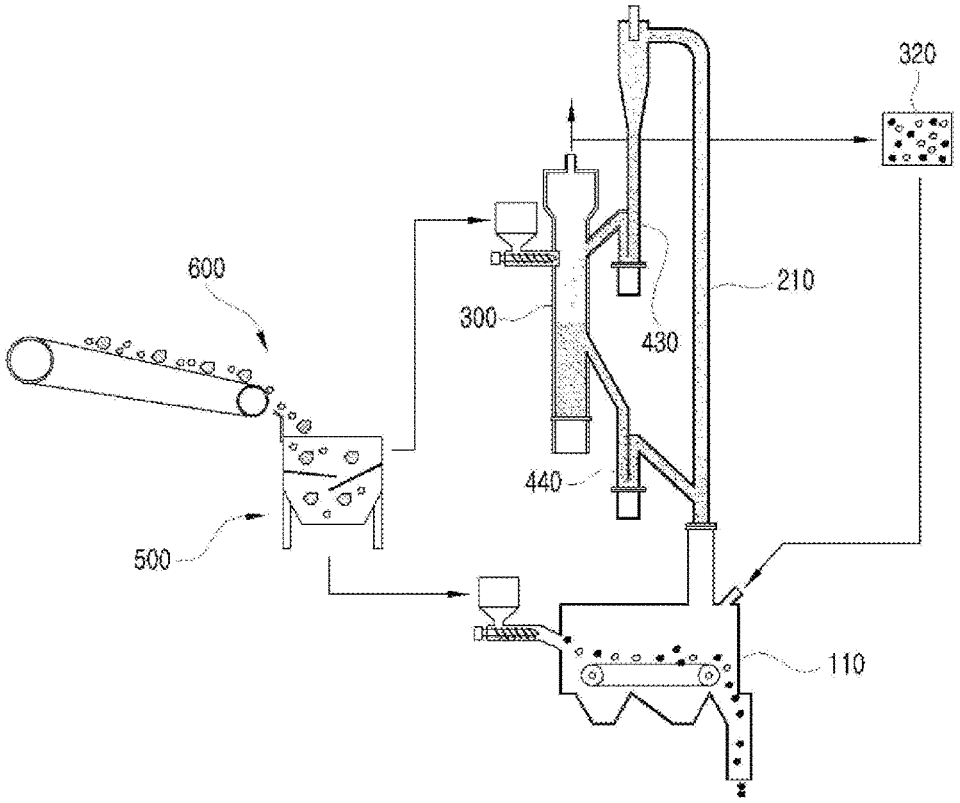

[FIG. 5]
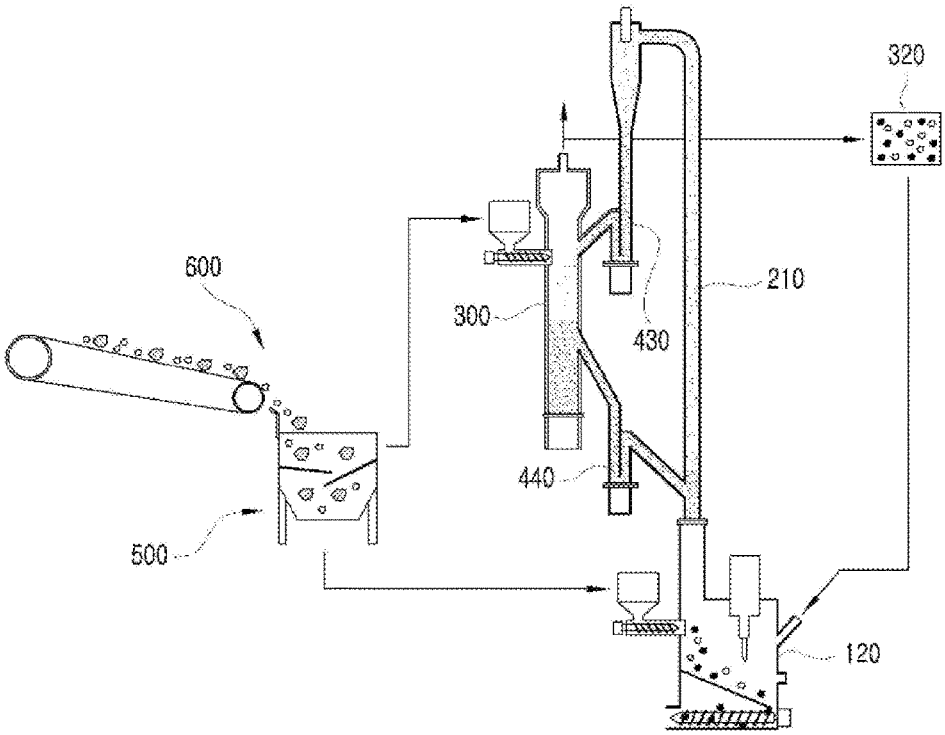

COMBUSTOR-INDEPENDENT FLUIDIZED BED INDIRECT GASIFICATION SYSTEM

TECHNICAL FIELD

The present invention relates to a combustor-independent fluidized bed indirect gasification system for technology for obtaining high quality synthetic gas (hereinafter, syngas) through effective indirect gasification of low quality fuels, such as biomass/waste/coal, having various properties.

BACKGROUND ART

A fluidized bed indirect gasification system may be comprised of two or more fluidized bed reactors which are separated into a gasifier and a combustor.

Conventional fluidized bed indirect gasification systems use steam as a gasifying agent and air as an oxidizing agent.

In particular, the gasifying agent and oxidizing agent may vary as necessary.

An indirect gasification system has a structure that a combustion gas is not mixed with a syngas generated in a gasifier because the system consists of a gasifier and a combustor, which are separated. Therefore, the syngas generated in the gasifier is not diluted with the combustion gas, and the system thus enables the production of syngas with high heating value.

The indirect gasification system requires a heat carrier that can transfer heat to a gasifier, where an endothermic reaction occurs, from a combustor.

For the heat transfer, a heat pipe or various other kinds of heat carriers may be used, and a bed material that is transported between the combustor and the gasifier serves the function of heat transfer in the case of a fluidized bed system.

The bed material performs heat transfer as it circulates through the combustor and the gasifier; the temperature of the bed material is increased to a high temperature in a combustor and the bed material is separated from the combustion gas via cyclone and supplied to the gasifier; the bed material, the temperature of which was decreased by a gasification reaction (i.e., an endothermic reaction), is again supplied to the combustor along with the unreacted carbon (char) remaining in the gasifier and burns the unreacted carbon; and the heat generated therefrom is again used to increase the temperature of the bed material, and the operation is performed as such.

In particular, an auxiliary fuel is provided to the combustor as necessary for temperature control.

Generally, low quality fuels, such as biomass/waste/coal, have various properties and they differ significantly with regard to physical characteristics, chemical characteristics, contents of impurities, etc.

Specifically, the factors that have the most significant effect on gasification and combustion may be the heating value, water content of a fuel, impurities contained in the fuel, environmental contamination-inducing materials as incombustibles such as ashes, stones, metals, glass, heavy metals, sulfur, chlorine, etc.

Among them, the operation problems due to incombustibles or impurities in a solid phase are ranked on the top.

Specifically, in the case of the waste among the various kinds of low quality fuels, it is essential to separate and sort out the incombustibles contained therein during the pretreatment process.

In particular, the amount of incombustibles may vary significantly depending on the sorting process, and various incombustibles which are hard to separate depending on the sorting process are present. Even those fuels with a high impurity content may need to be used as a fuel if they contain at least a certain amount of combustible components.

In the case of fluidized bed indirect gasification systems, they differ in the degree of operation problems due to these impurities (incombustibles) according to the type of a gasifier or combustor, and specifically, the operation problem due to the incombustibles in solid phase accounts for the majority of the operation problems.

In the case of conventional indirect gasification systems, they have a fatal problem in that the impurities and inorganic materials contained in the fuels lower the melting point of bed materials and induce adhesion of bed materials at low temperatures, thereby causing an operation problem in the entire system.

Additionally, one of the most serious problems in the fluidized bed systems is the abrasion of reactor refractory by the bed materials, and in particular, the presence of a high content of incombustibles, such as metals, stones, glass, etc., in the low quality fuels may cause a serious damage on the inner wall of the reactor thereby reducing the lifecycle of a plant.

Meanwhile, in the case of the fluidized bed indirect gasification systems, where at least two reactors are required and the continuous transfer of heat and materials between the two reactors is important, there is a higher risk of the occurrence of the operation problem compared to the single fluidized bed.

Additionally, the fluidized bed indirect gasification systems have a problem in that the gasifier and the combustor have a very strong correlation with respect to heat and materials, and thus the optimal operation range for both reactors is very narrow.

Furthermore, in the case of conventional indirect gasification systems, they have a problem in that the occurrence of a problem in one of the reactors can cause the instability of the entire system due to the strong interaction between the two reactors.

(Patent Literature 1) Korean Patent Application Publication No. 2012-0124403

DISCLOSURE

Technical Problem

Under the circumstances, the present invention has been made to overcome the above-mentioned conventional technical problems. Accordingly, as a method for minimizing the operation problems due to the presence of incombustibles in a low quality fuel, the present invention provides a combustor, which is responsible for heat supply, separately from a gasifier and a unit for increasing the temperature of a bed material in an indirect gasifier; and the fuel containing a lower content of the incombustibles is supplied to the gasifier while the fuel containing a higher content of the incombustibles is supplied to the combustor by treating the low quality fuel using a pre-processor, thereby removing incombustibles or impurities and transferring the heat released therefrom to the unit for increasing the temperature of a bed material. As a result, an object of the present is to provide a combustor-independent indirect gasification system capable of reducing impurities in gaseous phase within the syngas while minimizing the operation problems due to incombustibles or impurities.

Technical Solution

To solve the above-mentioned problems, the present invention provides a combustor-independent fluidized bed indirect gasification system, which includes: a pre-processor having a sorter 500; a gasifier 300 to which a first fuel sorted in the pre-processor is supplied; a combustor 100 to which a second fuel sorted in the pre-processor is supplied; and a riser 200 which connects the gasifier 300 and the combustor 100 and has the functions of increasing the temperature of a bed material and transferring the bed material therein.

Additionally, the combustor-independent fluidized bed indirect gasification system of the present invention includes a dispersion section 101 provided between the riser 200 and the combustor 100.

Additionally, the combustor-independent fluidized bed indirect gasification system of the present invention further includes a transfer unit 310, which connects the gasifier 300 and the combustor 100 and transfers incombustibles and unreacted char accumulated in the gasifier 300 to the combustor 100.

Additionally, the combustor-independent fluidized bed indirect gasification system of the present invention further includes a separator 320 provided between the combustor 100 and the gasifier 300, wherein the unburned portion and tar contained in the syngas released by the gasifier 300 are separated in the separator 320 and supplied again to the combustor 100 for combustion.

Additionally, the combustor-independent fluidized bed indirect gasification system of the present invention includes a first hollow passage 410 which connects a lower part of the riser 200 and the gasifier 300 at a location higher than the lower part of the riser 200; and a second hollow passage 420 which connects a lower part of the gasifier 300 and the riser 200 at a location higher than the lower part of the gasifier 300.

Additionally, in the combustor-independent fluidized bed indirect gasification system of the present invention, the first hollow passage 410 and the second hollow passage 420 are crisscrossed with each other.

Additionally, in the combustor-independent fluidized bed indirect gasification system of the present invention, the transfer unit 310 is connected to a lower part of the gasifier 300 at one end thereof and connected to a lower part of the riser 200 at the other end thereof.

Advantageous Effects of the Invention

The present invention described above has the following effects.

First, the system of the present invention separately provides a combustor and thus can treat most impurities in a combustor and use only the heat generated during combustion for gasification so as to separate not only the gaseous materials released from the combustor but also solid materials. Therefore, the system of the present invention has strong advantages in that it can remarkably reduce operation problems due to incombustibles, and simultaneously, reduce the impurities in the syngas, as compared to with conventional indirect gasification systems which focus only on the separation of gaseous materials in the form of separating combustion gas and syngas.

Second, the system of the present invention has an advantage in that the control function of the entire system can be enhanced because the operation of the combustor is separated thus weakening the correlation between a combustor and a gasifier.

Third, the system of the present invention has an advantage in that a problem in a combustor will not result in a problem in the entire system, unlike the existing indirect gasification system, and thus it may require the repair of only the combustor part.

Fourth, the system of the present invention has an advantage in that the utilization of a grate method or stoker method for a combustor instead of a fluidized bed enables the operation at a temperature higher than the highest operation temperature (1000° C.) for fluidized bed thus enabling a more efficient operation.

Fifth, the system of the present invention has an advantage in that the temperature of a combustor can be controlled by installing a separate heat exchanger when the temperature of the combustor is higher than that of a bed material in the heat exchange unit, as is the case with the existing boiler.

Sixth, the system of the present invention has an advantage in that more various fuels (e.g., fuels which are difficult to crush) can be used and also the expenses for crushing can be reduced.

Seventh, the system of the present invention has a strong advantage in that when, in producing a syngas by mixing biomass and coal, a syngas can be produced more easily by mainly utilizing biomass in the gasifier while mainly utilizing coal in the combustor and the burden for purification of the syngas can be significantly reduced.

Eighth, the system of the present invention has advantages in that the durability of the entire system can be extended because the combustor is operated independently and partially that the durability of the combustor is increased.

Ninth, the system of the present invention has an advantage in that the burden for purification in a separator can be significantly reduced by mainly using a fuel with more contamination sources in a combustor while mainly using a fuel with relatively less contamination sources in a gasifier.

Tenth, the system of the present invention has an advantage in that various types of fluidized bed systems, such as a bubbling fluidized bed, a fast fluidized bed, etc., can be selectively used in a riser that increases the temperature of a bed material using a combustion gas, because a combustor is operated separately.

Eleventh, the system of the present invention has a strong advantage in that, since only gasification and heat exchange modules can be further provided for their utilization in the existing boiler installed therein, the combustion gas in the existing boiler can be utilized partially or entirely according to the purpose of use thereby enabling the production of high quality syngas with a low investment cost.

Twelfth, the system of the present invention has an advantage in that, since the heat exchange unit can be used as a combustor without additional change in the facility, as is the case with the existing fluidized bed indirect gasification system, only a combustor can be used separately without operating a gasifier when the production of syngas is not necessary, thus improving the scope of its application.

Thirteenth, the system of the present invention has an advantage in that, since the subject fuel is separated before combustion, a high quality fuel can be supplied to a gasifier while a low quality fuel containing a high content of impurities is supplied to a dedicated combustor, thereby enabling optimized operation.

Fourteenth, the system of the present invention has a strong advantage in that, since the heat generated by a combustor, which is operated separately, is transferred to a gasifier wherein a combustion gas is released and the heat necessary for the operation of the gasifier is supplied via a bed material, the negative effect of impurities and incombustibles contained in the low quality fuel supplied to a combustor on a gasification process can be minimized thereby capable of maximizing the operation efficiency.

Fifteenth, the system of the present invention has an advantage in that a stable operation range can be secured by weakening the correlation between a gasifier and a combustor, while enabling simultaneously obtaining high quality syngas with further improvement.

BRIEF DESCRIPTION OF DRAWINGS

FIG. 1 is a diagram illustrating the entire configuration of the system according to a preferred first embodiment of the present invention.

FIG. 2 is a diagram illustrating the entire configuration of the system according to a preferred second embodiment of the present invention.

FIG. 3 is a diagram illustrating the entire configuration of the system according to a preferred third embodiment of the present invention.

FIG. 4 is a diagram illustrating the entire configuration of the system according to a preferred fourth embodiment of the present invention.

FIG. 5 is a diagram illustrating the entire configuration of the system according to a preferred fifth embodiment of the present invention.

MODE FOR CARRYING OUT THE INVENTION

The present invention will be explained in detail with reference to the accompanying drawings.

In the course of explanation, the thickness of lines, the size of constitutional features, etc., depicted in the drawings may be expressed in an exaggerated manner for convenience purposes. Additionally, the terms described herein below are those which are defined in consideration of the functions in the present invention and they may vary according to the user(s), and the intentions or practices of the user(s). Accordingly, the definitions on these terms shall be described based on the contents of the entire specification.

FIG. 1 is a diagram illustrating the entire configuration of the system according to a preferred first embodiment of the present invention.

FIG. 2 is a diagram illustrating the entire configuration of the system according to a preferred second embodiment of the present invention.

FIG. 3 is a diagram illustrating the entire configuration of the system according to a preferred third embodiment of the present invention.

FIG. 4 is a diagram illustrating the entire configuration of the system according to a preferred fourth embodiment of the present invention.

FIG. 5 is a diagram illustrating the entire configuration of the system according to a preferred fifth embodiment of the present invention.

Schematic Explanations on Entire Constitution

The entire constitution of the present invention will be explained first followed by a detailed explanation of the constitution.

The pre-processor of the present invention includes a sorter 500.

A first fuel sorted in the sorter 500 of the pre-processor is supplied to a gasifier 300.

That is, the first fuel, which is a high quality fuel sorted in the sorter 500 and does not contain wastes, solid incombustibles, unburned materials, etc., is supplied to the gasifier 300.

A second fuel sorted in the pre-processor is supplied to the combustor 100.

That is, the second fuel, which is a low quality fuel sorted in the sorter 500 and may contain a higher content of solid incombustibles and impurities not suitable for gasification, is supplied to the combustor 100.

A chamber 103 is provided in the combustor 100 and air necessary for combustion is supplied to the chamber.

A riser 200 connects the gasifier 300 and the combustor 100.

More specifically, the riser 200 has a structure in which one end is connected to an upper end of the combustor 100 and the other end is connected to the gasifier 300.

That is, the riser 200 refers to a part which is connected to an upper part of the combustor 100 and a bed material is fluidized therein.

The bed material passes through the riser 200 and then a first transport pathway 430, and applies heat energy while being injected into the gasifier 300, and then again passes through a second transport pathway 440 and is circulated into the riser 200.

Preferably, a dispersion section 101 is provided between the riser 200 and the combustor 100.

The dispersion section 101, which will be described later, has the role of releasing the heat generated in the combustor 100 to an upper part thereof and preventing the penetration of a bed material into the combustor 100 when the bed material, which is fluidized by being contained in the riser 200, descends by gravity.

That is, the dispersion section 101 is one which performs the role of rightly providing only the heat generated in the combustor 100 to the bed material of the riser 200 and the structure does not matter as long as it can perform the role.

Additionally, the unburned portion and tar contained in the syngas may be integrated and removed in the combustor 100 without additional purification process, by including a process of separating the unburned portion and tar contained in the syngas released by the in the separator 320 and supplying it again to the combustor 100 for combustion.

In a second preferred embodiment of the present invention, the present invention may further include a transfer unit 310.

The transfer unit 310 connects the gasifier 300 and the combustor 100 together.

More specifically, the transfer unit 310 has the role of transferring incombustibles and unreacted char accumulated in the gasifier 300 to the combustor 100.

That is, the transfer unit 310 sends the incombustibles and unreacted char that may still remain in the gasifier 300 to the combustor 100 for combustion again.

Meanwhile, in a third preferred embodiment of the present invention, the present invention may further include a first hollow passage 410 and a second hollow passage 420.

The first hollow passage 410 is connected between a lower part of the riser 200 and the gasifier 300 at a location higher than the lower part of the riser 200 thereof.

The second hollow passage 420 is connected between a lower part of the gasifier 300 and the riser 200 at a location higher than the lower part of the gasifier 300 thereof.

More specifically, one end of the first hollow passage 410 is connected to the lower part of the riser 200 and the other end of the first hollow passage 410 is connected to the upper part of the gasifier 300.

That is, a first position 710, in which one end of the first hollow passage 410 is connected to the lower part of the riser 200, is preferably formed to be lower than a second position 720, in which the other end of the first hollow passage 410 is connected to the upper part of the gasifier 300.

Meanwhile, one end of the second hollow passage 420 is connected to the lower part of the gasifier 300 and the other end of the second hollow passage 420 is connected to the upper part of the riser 200.

That is, a third position 730, in which one end of the second hollow passage 420 is connected to the lower part of the gasifier 300, is preferably formed to be lower than a fourth position 740, in which the other end of the second hollow passage 420 is connected to the upper part of the riser 200.

That is, the first position 710 and the third position 730 may be formed at the same height and the second position 720 and the fourth position 740 may be formed at the same height.

In particular, the first position 710 and the third position 730 are formed to be lower than the second position 720 and the fourth position 740.

That is, the first hollow passage 410 and the second hollow passage 420 are preferably formed to be crisscrossed in an X-shape.

Explanation of Technology

An indirect gasification system is a system capable of producing syngas with high heating value because a combustion gas is prevented from being mixed into the produced gas by separating the gasifier 300 from the combustor 100.

The indirect gasification system requires a heat carrier that can transfer heat to supply heat from the combustor 100 to the gasifier 300, where an endothermic reaction occurs.

A heat pipe or various other heat carriers may be used for heat transfer and, in a case of fluidized bed system as in the present invention, a bed material serves the role.

However, low quality fuels, such as biomass/waste/coal, generally have various properties and they differ significantly with regard to physical characteristics, chemical characteristics, contents of impurities, etc.

Specifically, the factors that have the most significant effect on gasification and combustion may include heating value, water content of a fuel, impurities and incombustibles (e.g., ashes, stones, metals, glass, heavy metals, sulfur, chlorine, other environmental pollutants, etc.) contained in the fuel.

In a case when biomass, wastes, coal, etc., are used together, it is highly necessary that these various fuels be used separately rather than mixing them together for use.

For example, coal has a high ash content, a low content of volatiles, and contains many harmful materials such as sulfur, etc., whereas biomass has a low ash content, a high content of volatiles, and contains less harmful materials.

Accordingly, in producing syngas by mixing biomass and coal, when biomass, a high quality fuel, is mostly used in the gasifier 300 while coal, a low quality fuel, is mostly used in the combustor 100, the syngas production can be more easily done and the burden on the purification of the syngas produced can be significantly reduced.

The present invention is a method for minimizing the operation problems due to the incombustibles contained in low quality fuels and is characterized in that the combustor 100, which is responsible for heat supply to the indirect gasifier 300, is provided separately from the gasifier 300 and the unit for increasing the temperature of a bed material in the indirect gasifier 300.

A First Embodiment

The sorting unit of the present invention sorts out fuels as the first fuel, a high quality fuel, and the second fuel, a low quality fuel.

The sorting process may be able to distinguish fuels through the same sorting process or different sorting processes (e.g., a high quality fuel can be obtained in the flow where more sorting processes are included.

Meanwhile, coal, biomass, etc., may be classified according to their kinds, without additional pre-process.

The first fuel, a high quality fuel, is a fuel suitable for gasification due to a high content of volatiles and has high heating value.

The first fuel with such a low content of incombustibles is used as a main fuel in the gasification system and supplied to the gasifier 300.

Meanwhile, the second fuel, which has low heating value and a high content of incombustibles, is sent to the combustor 100 and used for the production of a combustion gas.

For the combustor 100, any combustor 100 suitable for the subject fuel, such as grate firing, fixed bed, etc., including fluidized bed, can be selectively utilized.

The high-temperature combustion gas generated by combustion serves to immediately heat the bed material, which was cooled after being supplied to the riser 210 of the gasifier 300.

The combustion gas, which heated the bed material, is separated from the bed material in the cyclone connected to the upper end of the riser 210 and released.

The bed material, whose temperature was increased, supplies heat necessary for the endothermic reaction for gasification, circulated again into the riser 210, and establishes a cycle.

The riser 210 is the part where the temperature of the bed material is increased in the gasifier 300.

In the riser 210, the excess air ratio in the combustor 100 can be controlled so that a part of an oxidizing agent can be present in the combustion gas to thereby serve the function of combustion (partial oxidation) of unreacted char transferred to the gasifier 300.

Since the combustor 100 enables an independent operation in the entire system of the present invention, the correlation of the entire system can be weakly maintained due to the independent separated operation of the combustor 100, thereby enhancing the control function of the entire system.

Even when a problem occurs in the combustor 100, it would not induce a problem in the entire system, and thus it only requires the resolution of the problem in the combustor 100 itself.

Additionally, one of the most serious problems in the fluidized bed systems is the abrasion by bed materials, and in particular, the presence of a high content of incombustibles, such as metals, stones, glass, etc., may cause a serious damage on the inner wall of the reactor thereby reducing the lifecycle of a plant. However, if these low quality fuel materials are treated independently in the combustor 100, the durability of the entire system can be extended and it only requires partial management, i.e., the durability of the combustor 100.

In addition, sulfur and chlorine components and other contamination-inducing materials, etc., in the fuel may be released during the gasification process in the form of an acidic gas, ammonia, dioxin, and other various harmful gases, and for the purification of these gases, it is necessary to provide additional facility for purification, which is one of the factors that reduce the economic efficiency and stability of the gasification system. However, according to the first preferred embodiment of the present invention, when the fuel with high contents of such contaminating sources is mainly used in the combustor 100 and the fuel with relatively low contents of the contaminating sources is mainly used in the gasifier 300, it can significantly reduce the burden for purification in the separator of the gasifier 300.

Meanwhile, it is also very preferable that the temperature of the combustor 100 can be controlled by installing a separate heat exchanger when the temperature of the combustor is higher than that of a bed material in the heat exchange unit.

Additionally, the unburned portion and tar contained in the syngas may be integrated and removed in the combustor 100 without additional purification process, by including a process of separating the unburned portion and tar contained in the syngas released by the gasifier 300 in the separator 320 and supplying it again to the combustor 100 for combustion.

A Second Embodiment

A bed material performs heat transfer while circulating the riser 210 and the gasifier 300. The temperature of the bed material is increased to a high temperature in the riser 210 and the bed material is separated from the combustion gas via cyclone and supplied to the gasifier 300; the bed material, the temperature of which was decreased by an endothermic reaction, is again supplied to the riser 210 along with the unreacted carbon (char) remaining in the gasifier 300 and burns the unreacted carbon using the oxygen contained in the combustion gas to contribute to the increase of the temperature of the bed material; and the unburned portion in the riser 210 is transferred again to the gasifier 300 and participates in the gasification reaction.

Meanwhile, if the unburned portion or incombustibles are accumulated in a certain amount or higher, they can be transferred to the combustor 100 through a transfer unit 310, and if necessary, the bed material, incombustibles, and unburned portion can be separated in the transfer unit 310, and only the incombustibles and unburned portion can be transferred to the combustor 100.

By doing so, the incombustibles can be treated by utilizing the incombustible-treating facility in the combustor 100 without additional equipment to the gasifier 300.

In particular, the combustor 100 requires a positive pressure operation so as to smoothly supply a combustion gas to the fluidized bed riser 210.

Generally, the operation of fluidized bed requires a pressure of at least 0.3 atm or higher and thus it is preferred that the pressure be maintained in the above range.

Meanwhile, if necessary, the temperature may be controlled by injecting an auxiliary fuel into the combustor 100.

A Third Embodiment

In a third preferred embodiment of the present invention, a first hollow passage 410 and a second hollow passage 420 may be further provided.

The first hollow passage 410 connects a lower part of the riser 200 and the gasifier 300 at a location higher than the lower part of the riser 200.

The second hollow passage 420 connects a lower part of the gasifier 300 and the riser 200 at a location higher than the lower part of the gasifier 300.

More specifically, one end of the first hollow passage 410 is connected to the lower part of the riser 200 and the other end of the first hollow passage 410 is connected to the upper part of the gasifier 300.

That is, a first position 710, in which one end of the first hollow passage 410 is connected to the lower part of the riser 200, is preferably formed to be lower than a second position 720, in which the other end of the first hollow passage 410 is connected to the upper part of the gasifier 300.

Meanwhile, one end of the second hollow passage 420 is connected to the lower part of the gasifier 300 and the other end of the second hollow passage 420 is connected to the upper part of the riser 200.

That is, a third position 730, in which one end of the second hollow passage 420 is connected to the lower part of the gasifier 300, is preferably formed to be lower than a fourth position 740, in which the other end of the second hollow passage 420 is connected to the upper part of the riser 200.

That is, the first position 710 and the third position 730 may be formed at the same height and the second position 720 and the fourth position 740 may be formed at the same height In particular, the first position 710 and the third position 730 are formed to be lower than the second position 720 and the fourth position 740.

That is, the first hollow passage 410 and the second hollow passage 420 are preferably formed to be crisscrossed in an X-shape.

By having such a constitution, the bed material, the temperature of which is increased by heating in the combustor 100, only needs to arrive at the fourth position 740 not necessitating its arrival at the topmost position in the riser 200, and thus there is no need for additional supply of unnecessary energy.

The bed material which has arrived at the fourth position 740 is guided by the second hollow passage 420 and dropped in the lower left direction and transferred into the third position 730.

The bed material transferred to the third position 730 transfers heat to the gasifier 300, transferred again to the second position 720, and returns to the first position 710 along the first hollow passage 410.

That is, according to the third embodiment of the present invention, the fluidization cycle of a bed material can be fluidized with a lower potential energy and thus the operation efficiency can be maximized.

A Fourth Embodiment and a Fifth Embodiment

In the case of a fluidized bed system, a local high-temperature phenomenon can generally occur in the combustor and thus operation conditions that go beyond the melting point of a bed material can occur multiple times.

Generally, when sand is used as a medium for fluidization, the operation temperature does not go over 1000° C. Specifically, in the case of some low quality fuels, their melting points can be significantly lowered due to the effect by the inorganics contained in the fuels.

In this case, a fatal operation problem can occur in the entire system but such a risk is not present in the present invention.

Even when there is a problem in the combustor it would not induce a problem in the entire system unlike the existing indirect gasification system, and thus it would require the repair of only the combustor part.

Additionally, the utilization of a stoker method as illustrated in FIG. 4, a grate method as illustrated in FIG. 5, etc., for a combustor instead of a fluidized bed enables the operation at a temperature higher than the highest operation temperature (1000° C.) for fluidized bed thus enabling a more efficient operation.

The structure of the combustor 110 for the stoker method as illustrated in FIG. 4 is different from that of the combustor 100.

In the stoker method, the inside of the combustor 110 is configured so that a conveyer belt or a fuel transferring system such as a multi-step pusher, etc., can be provided.

Meanwhile, in the combustor 120 of the grate method as illustrated in FIG. 5, an auxiliary burner can be provided inside of the combustor, whereas a screw is provided in the lower part of the combustor 120 of the grate method, thus capable of pushing out the burned residues such as ashes, etc., to the outside.

Even in the combustors of the grate method or stoker method, it is preferable to have a pre-processor including the sorter 500 as in the first embodiment of the present invention.

As explained in the first preferred embodiment of the present invention, the sorter 500 enables to provide the first fuel (i.e., a high quality fuel) to the gasifier 300 while providing the second fuel (i.e., a low quality fuel) to the combustor 110 of the stoker method 110 or the combustor 120 of the grate method.

Meanwhile, it is necessary to standardize the fuel size to a range of a few millimeters to a few centimeters during the process of pretreatment for the smooth fluidization of a fluidized bed. However, when the combustor 100 is used in the combustor 110 of the stoker method or the combustor 120 of the grate method, the standardization is not necessary and thus various kinds of fuels, e.g., fuels which are difficult to crush, etc., can be used thereby capable of reducing the cost for crushing.

In various preferred embodiments of the present invention, the gasifier 300 part was mainly explained as the fluidized bed, but a moving bed may also be used as necessary, and various types of fluidized beds such as a bubbling fluidized bed, a fast fluidized bed, etc., may be used.

The heat exchange and partial oxidation part expressed as a riser (in fact, riser includes the meaning of a fast fluidized bed) may also be in the form of a bubbling fluidized bed, and it is also possible to combine various types of reactors as necessary as long as they can meet the above constitution.

Meanwhile, in various preferred embodiments of the present invention, the gasifier 300 may be utilized by further providing only modules for gasification and heat exchange to the already installed boiler.

In particular, the combustion gas of the existing boiler may be used entirely or in part depending on the user's purpose, and in this case, the method may be utilized as a method for producing a high quality syngas with a low investment cost.

Additionally, if necessary, the riser 210 may be used as the combustor 100 without a further change in facility, as is the case of the existing fluidized bed indirect gasifier, and in a case when a syngas production is not necessary, the combustor 100 may be used separately without operating the gasifier 300, thus capable of widening the range of its application.

Basically, the present system can be comprised of three reactors such as the gasifier 300, the riser 210, and the combustor 100 as illustrated in the schematic drawing, and the number of reactors may be changed to one or more reactors as necessary.

In the above, the present invention has been explained with reference to the preferred embodiments, however, one of ordinary skill in the art to which the present invention pertains will be able to understand that the present invention may be amended or modified in various forms without departing from the technical concepts and ranges of the present invention described in the claims herein below.

CODE EXPLANATION

100, 110, 120: Combustor
101: Dispersion section
103: Chamber
200, 210: Riser
300: Gasifier
310: Transfer unit
320: Separator
410: First hollow passage
420: Second hollow passage
430: First transport pathway
440: Second transport pathway
500: Sorter
600: Supply unit
710: First position
720: Second position
730: Third position
740: Fourth position

The invention claimed is:

1. A combustor-independent fluidized bed indirect gasification system, comprising:

a pre-processor having a sorter;

a gasifier to which a first fuel sorted in the pre-processor is supplied;

a combustor to which a second fuel sorted in the pre-processor is supplied;

a riser which connects the gasifier and the combustor and allows a bed material to be fluidized and increases the temperature of the bed material by heat generated by combustion in the combustor so as to transfer the bed material to the gasifier;

a dispersion section provided between the riser and the combustor so as to transfer the heat generated by the combustor to the bed material fluidized in the riser and to prevent the penetration of the bed material fluidized in the riser into the combustor;

a separator provided external to the combustor and gasifier and between the combustor and the gasifier;

a first hollow passage which is connected between a lower part of the riser and the gasifier at a location higher than the lower part of the riser; and a second hollow passage which is connected between a lower part of the gasifier and the riser at a location higher than the lower part of the gasifier;

wherein the connection of the first hollow passage to the gasifier is below the top of the gasifier;

wherein the connection of the second hollow passage to the riser is below the top of the riser; and wherein an unburned portion and tar contained in a syngas released by the gasifier are separated in the separator and supplied again to the combustor for combustion.

2. The combustor-independent fluidized bed indirect gasification system of claim 1, further comprising a transfer unit, which connects the gasifier and the combustor and transfers incombustibles and unreacted char accumulated in the gasifier to the combustor.

3. The combustor-independent fluidized bed indirect gasification system of claim 1, wherein the first and second hollow passages are crisscrossed with each other.

4. The combustor-independent fluidized bed indirect gasification system of claim 2, wherein the transfer unit is connected to a lower part of the gasifier at one end thereof and connected to a lower part of the combustor at the other end thereof.

5. The combustor-independent fluidized bed indirect gasification system of claim 1, wherein the separator is provided between the combustor and the top of the gasifier.

6. A combustor-independent fluidized bed indirect gasification system, comprising:

a pre-processor having a sorter;

a gasifier to which a first fuel sorted in the pre-processor is supplied;

a combustor to which a second fuel sorted in the pre-processor is supplied;

a riser which connects the gasifier and the combustor and allows a bed material to be fluidized and increases the temperature of the bed material by heat generated by combustion in the combustor so as to transfer the bed material to the gasifier;

a dispersion section provided between the riser and the combustor so as to transfer the heat generated by the combustor to the bed material fluidized in the riser and to prevent the penetration of the bed material fluidized in the riser into the combustor; and a separator provided external to the combustor and gasifier and between the combustor and the gasifier;

a first hollow passage which is connected between a lower part of the riser and the gasifier at a location higher than the lower part of the riser; and a second hollow passage which is connected between a lower part of the gasifier and the riser at a location higher than the lower part of the gasifier;

wherein the connection of the first hollow passage to the gasifier is below the top of the gasifier;

wherein the connection of the second hollow passage to the riser is below the top of the riser;

wherein the first and second hollow passages are crisscrossed with each other; and wherein the unburned portion and tar contained in the syngas released by the gasifier are separated in the separator and supplied again to the combustor for combustion.

* * * * *